US011198558B2

(12) United States Patent
Roman

(10) Patent No.: US 11,198,558 B2
(45) Date of Patent: Dec. 14, 2021

(54) CYLINDRICAL TWIST LOCK DEVICE

(71) Applicant: Artemio Roman, Houston, TX (US)

(72) Inventor: Artemio Roman, Houston, TX (US)

( * ) Notice: Subject to any disclaimer, the term of this patent is extended or adjusted under 35 U.S.C. 154(b) by 0 days.

(21) Appl. No.: 16/512,355

(22) Filed: Jul. 15, 2019

(65) Prior Publication Data

US 2020/0115154 A1 Apr. 16, 2020

Related U.S. Application Data

(60) Provisional application No. 62/697,599, filed on Jul. 13, 2018.

(51) Int. Cl.
*B65D 90/00* (2006.01)

(52) U.S. Cl.
CPC ..... *B65D 90/0013* (2013.01); *B65D 90/0026* (2013.01)

(58) Field of Classification Search
CPC ..... B65D 90/0013; B65D 2590/0083; B65D 19/385; B65D 19/44; B65D 21/0201; B65D 21/0233; B65D 2585/647
USPC ..... 410/77, 80, 69, 92, 2, 44, 104, 105, 97, 410/94; 244/118.1, 137.1, 118.6; 220/1.5, 324, 1.6, 315, 218, 694
See application file for complete search history.

(56) References Cited

U.S. PATENT DOCUMENTS

| | | | | |
|---|---|---|---|---|
| 3,261,070 | A * | 7/1966 | Abolins | B65D 88/121 24/287 |
| 3,752,511 | A * | 8/1973 | Racy | F16B 21/02 24/287 |
| 4,564,984 | A * | 1/1986 | Takaguchi | B65D 90/0013 24/287 |
| 6,164,862 | A * | 12/2000 | Takaguchi | B65D 90/0013 24/287 |
| 6,460,227 | B2 | 10/2002 | Hove | |
| 2001/0052169 | A1 | 12/2001 | Hove | |
| 2010/0290855 | A1 * | 11/2010 | Strien | B65D 90/0006 410/77 |
| 2015/0147130 | A1 * | 5/2015 | Metternich | B60P 7/132 410/82 |
| 2017/0044795 | A1 | 2/2017 | Hove | |
| 2017/0334061 | A1 | 11/2017 | Gallup et al. | |

FOREIGN PATENT DOCUMENTS

| | | |
|---|---|---|
| CN | 1961913 | 5/2005 |
| CN | 2016090402 | 5/2005 |

OTHER PUBLICATIONS

Wet, Inc., Waterfront Equipment Technologies, Locking and Unlocking Poles, Mar. 22, 2018, 2 pg., Rancho Palos Verdes, CA, U.S.

* cited by examiner

*Primary Examiner* — D Glenn Dayoan
*Assistant Examiner* — Sunsurraye Westbrook
(74) *Attorney, Agent, or Firm* — Delphine James

(57) ABSTRACT

The present invention comprises a hollow elongated shaft defined by an opened top and bottom end. The tool can be made of steel or another strong material. Formed on the top end and the bottom end of the shaft are coupling members specifically designed to attach to twistlock disposed between stacked shipping containers.

14 Claims, 5 Drawing Sheets

CYLINDRICAL TWIST LOCK DEVICE

This patent claims the benefit of provisional patent application 62/697,599.

BACKGROUND

The present invention relates to tools useful for securing shipping containers.

Intermodal shipping containers are used throughout the world. Transporting everything from bulk raw materials to refined goods, millions of shipping containers move each day. The intermodal container is a large standardized shipping container, used in intermodal freight transport. The intermodal container can be 40 foot long with each of the eight corners adapted with a twistlock fitting for hoisting, stacking, and securing. Thus, making the containers stackable for loading and transport on large ships feasible and efficient.

Intermodal freight transport involves the transportation of freight in an intermodal container using multiple modes of transportation (e.g., rail, ship, and truck), without any handling of the freight itself when changing modes. The method reduces cargo handling, and improves security, reduces damage and loss, and allows freight to be transported faster. Reduced costs over road trucking are the key benefit for intercontinental use. The applicant has developed a tool to assist in the securing and removal of the intermodal container during transport and storage.

Applicant has discovered a new and useful means for releasing and securing stacking twistlocks of intermodal shipping containers.

SUMMARY OF THE INVENTION

The present invention provides a tool for securing and releasing twist locks which are utilized to securely stack freight containers. Optionally, the tool also includes other components, such as features to engage other mechanisms useful in shipping, such as locking bars for opening shipping container doors, and twist locks for coupling and uncoupling shipping containers.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

BRIEF DESCRIPTION OF DRAWINGS

These and other details of the present invention will be described in connection with the accompany drawings, which are not furnished only by way of illustration and not in limitation of the invention.

DETAILED DESCRIPTION OF THE INVENTION

Hereinafter, an embodiment of the present invention will be described in detail with reference to the accompanying drawings. However, the present invention is not limited to the embodiment to be described below but may be implemented in various different embodiments. The embodiment is merely provided to completely disclose the present invention and completely inform those skilled in the art of the spirit of the present invention.

With reference now to the drawings, the twist lock tool is to secure and unsecure the containers on the freight ship. A major advantage of the twist lock tool is to lock containers in place on deck to keep them from moving. Even under various weather conditions the containers remain very simple to move. When corrosion is extensive the twistlock become dangerous to move crates. The present invention is utilized to secure and unsecure a twist lock mechanism.

The twistlock (20) contains a female part connector member and a male part connector member. The female connector is the 7×7×4½ in corner casting, which is fitted to the container itself, and has no moving parts, only an oval hole in the bottom. The male component is a stand alone member that is place within the female connector. The maximum size and position of the holes in the connector is defined in international standard ISO 1161:1984. The tensile strength of a twistlock is rated at either 20 or 25 tones. The twistlock (20) is used to stack the intermodal containers to prevent movement during storage on freight ships.

Figure 1:
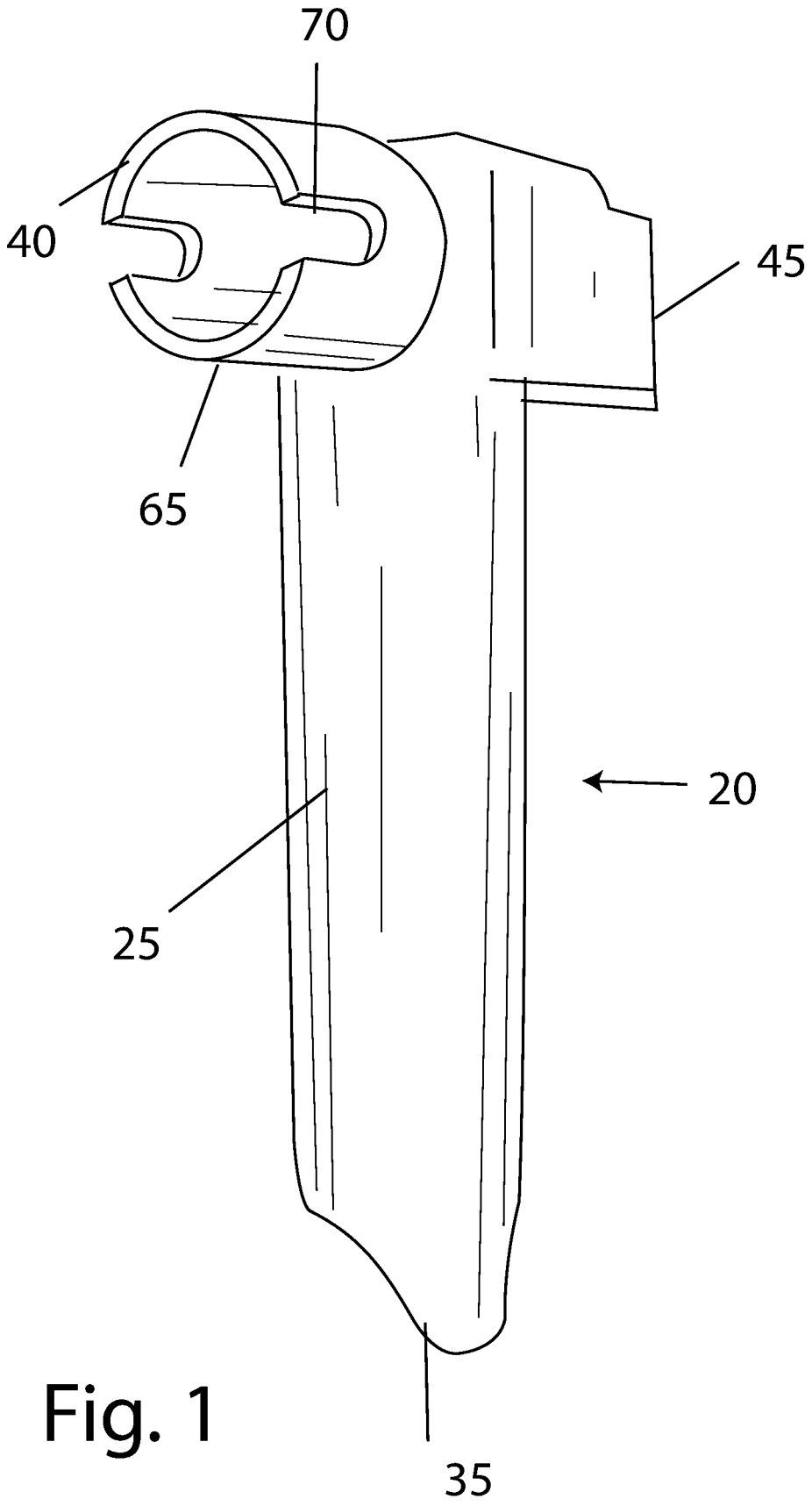
FIG. 1 depicts, in a front left-side perspective view
Figure 4:
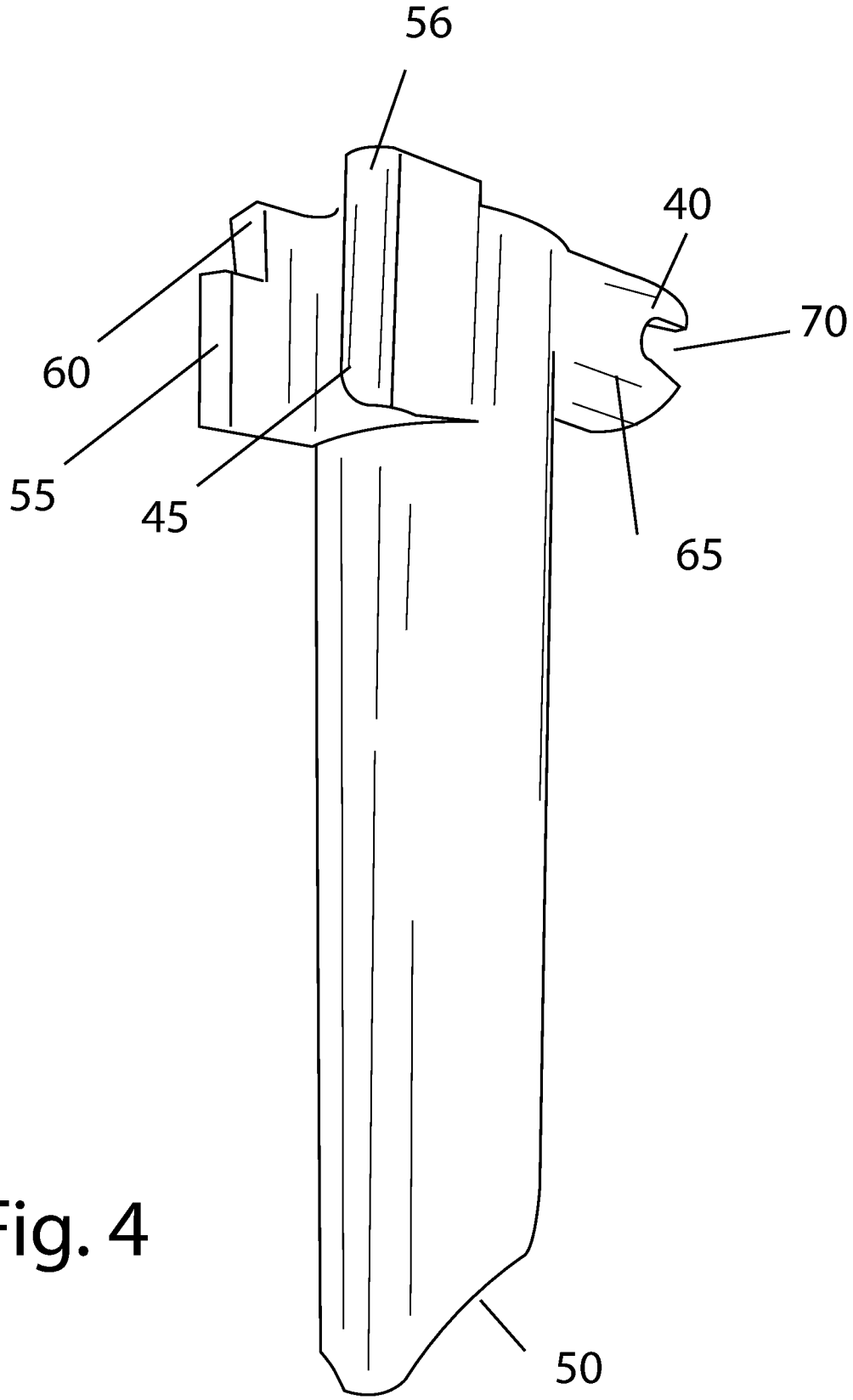
FIG. 4 depicts the tool in a side perspective view
Figure 5:
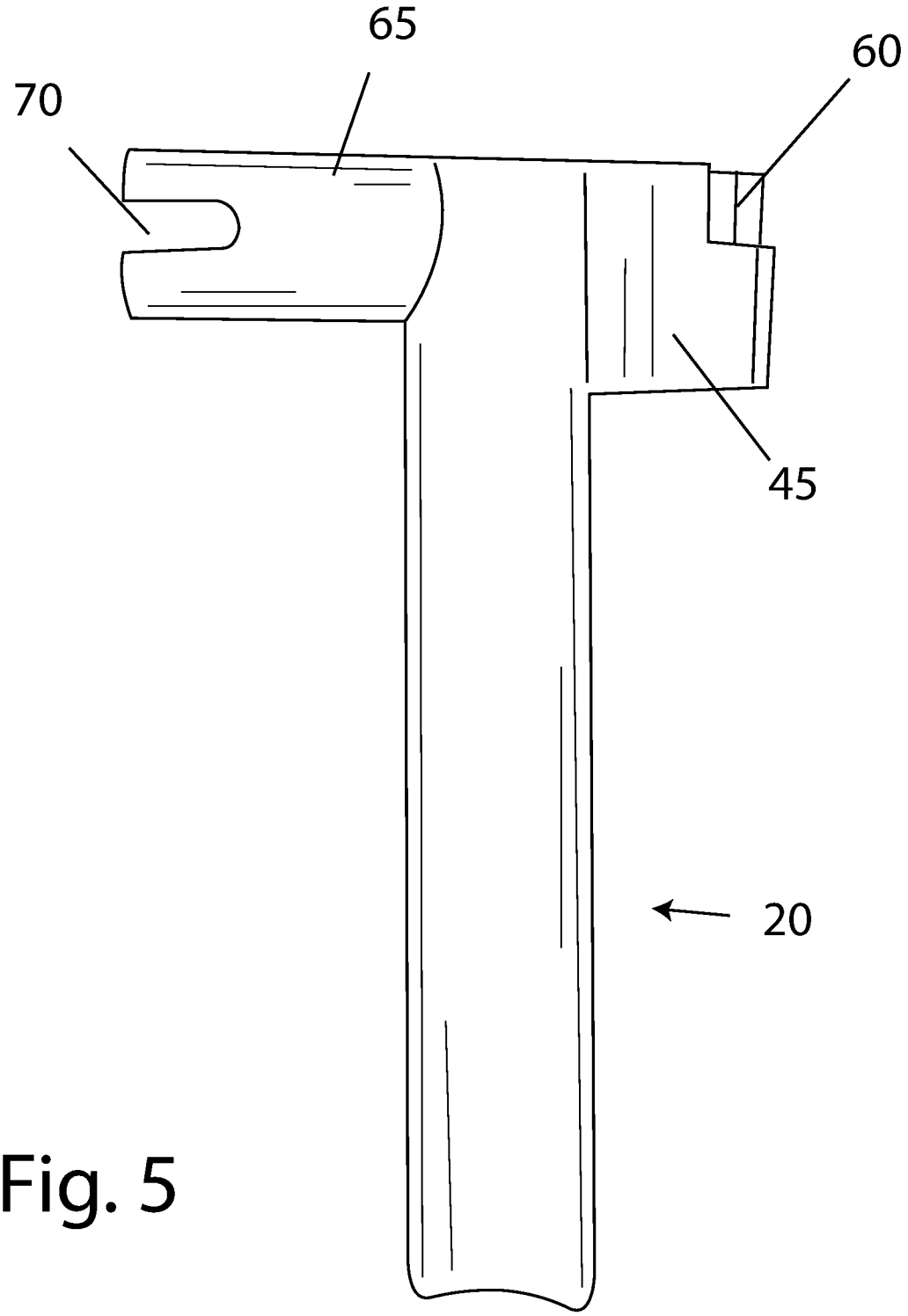
FIG. 5 depicts a right-side perspective view

The present invention provides a tool to secure and unsecure the twist lock device. The device comprises an elongated shaft member (25) and opposing coupling members (45, 65). The tool is preferably made of a strong sturdy material such as steel or another suitable compatible material. Elongated shaft (25) member comprises a cylindrical hollow tubular member that is defined by a top (30) and bottom end (35) as shown in FIG. 1. Formed on one side of the bottom end is a half circle arc (50) as shown in FIG. 2 and FIG. 4.

In the illustrated embodiment is the elongated shaft member (25) is cylindrical with both the top (30) and the bottom (35) being opened. In the preferred embodiment, the top end forms an annular ring of approximately one inch while the bottom end forms an a half circle are on one side of at least one inch. In the preferred embodiment, shaft member (25) is approximately 7 inches. However, the length of shaft, the diameter of the annular ring and the diameter of the arc can vary to support the twist lock size.

Figure 2:
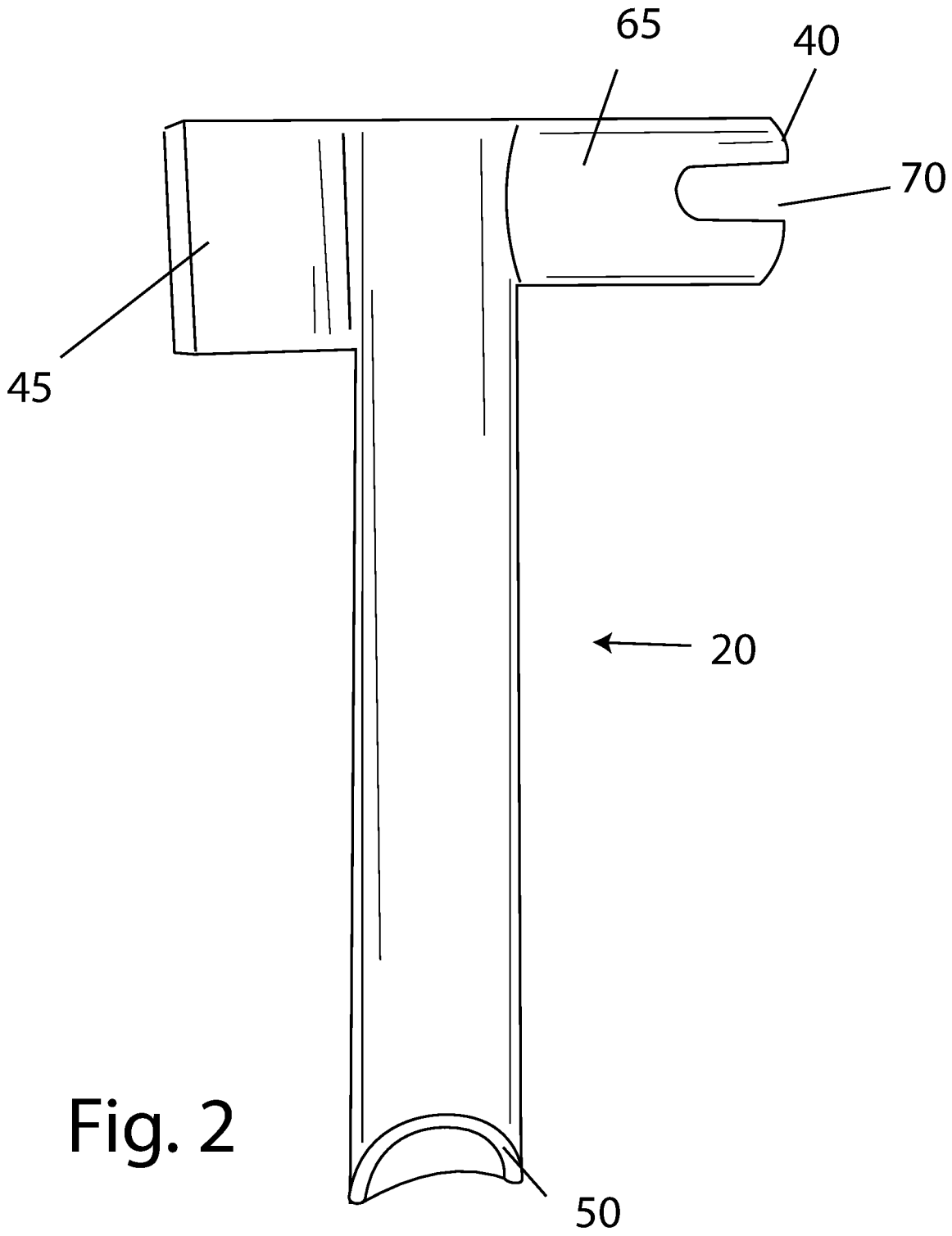
FIG. 2 depicts the tool in a front perspective view

Proximately, attached to opposing sides of the top end are a first coupling member (45) and an opposing second coupling member (65) as shown in FIG. 2. The first coupling member (45) compromises a recess member defined by a bottom wall that is integrally attached near the top end of the elongated shaft member (25) and extends vertically downward to a pre-determined distance. In the illustrated embodiment, the length of the first coupling member (45) is approximately one and half inches long. As shown in FIG. 4, extending from the opposing sides of the bottom wall are two opposing parallel side walls (55, 60) extending horizontally outward to form an opened channel there between. Each side wall is flat and extends to a slightly inwardly curved outer peripheral edge. As shown, an angular cutout is formed within along the curved outer peripheral edge.

Figure 3:
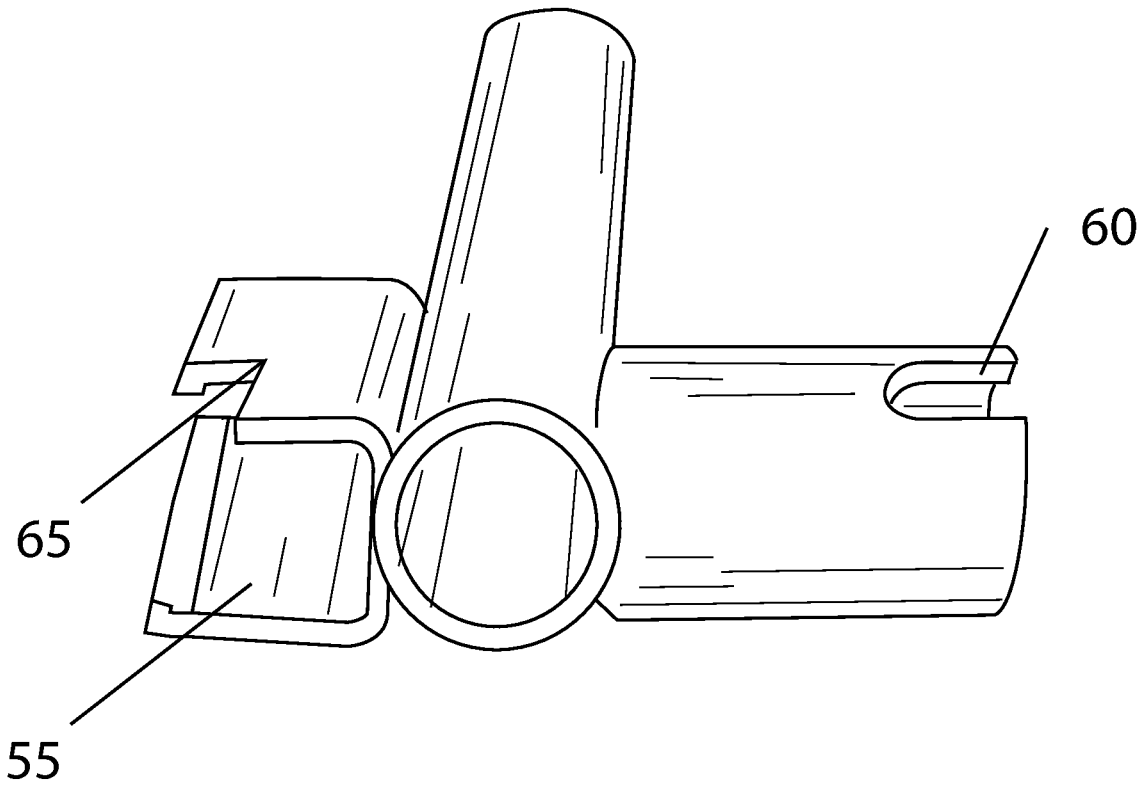
FIG. 3 depicts the tool in a top perspective view

The second coupling member (65) is small hollow cylindrical rod with one end perpendicularly attached to one side of top end (35) of shaft member (25) and extending to an opened terminal end having a pair of recessed channels (60). As shown each recessed channel (60) has a half rectangular cutout as shown in FIG. 3 and FIG. 4.

In use, the curved arc at the lower end of the shaft is placed upon the extending lever (80) of the twist lock (70)

and slid forward to surround lever (80). Once the lower end of shaft member (25) encircles extending arm (80), the user is allowed to pull downward and rotate the twist lock. Alternatively the channel between the opposing arms is placed over the extending lever (80) allowing the user to pull downward and rotate the twist lock. In use the, the opened shaft of the second coupling member is placed upon the rod (75) to allow the user to rotate the twist lock.

What is claimed is:

1. A locking tool to be used in combination with a twist lock, the tool comprising:

a shaft member defined by an upper end and a lower end;

the shaft member having a bore extending from the upper end to the lower end with the same diameter therethrough;

the lower end having a side with an arc curve with an apex pointing toward the upper end;

the upper end having a first coupler member directly opposed a second coupler member; the first coupler member having a cylindrical tubular member perpendicularly and fixably attached proximately near the upper end of the shaft member;

and the second coupler member defined by a back wall with a pair of symmetrical horizontally extending side walls in a parallel arrangement;

wherein a channel is defined therebetween.

2. The locking tool of claim 1 wherein the apex is centrally aligned along the longitudinal axis of the shaft member.

3. The locking tool of claim 1 wherein the first coupler having opposing symmetrical curve arcs in a parallel arrangement with each having a second apex pointing inwardly toward the shaft member.

4. The locking tool of claim 1 wherein the second coupler having aopposing symmetrical parallel side walls in a parallel extending laterally outward away from the shaft member.

5. The locking tool of claim 1 wherein the first coupler member is aligned flushed with the top end.

6. The locking tool of claim 1 wherein the second coupler member is aligned flushed with the top end.

7. The locking tool of clam 1 wherein the shaft member is 7 inches.

8. The locking tool of claim 1 wherein the top end of the shaft member is opened and forms an annular ring.

9. The locking tool of claim 1 wherein the opposing side walls terminated with a peripheral edge that curves inwardly.

10. The locking tool of claim 1 wherein the first coupler is 1 and ½ inches long.

11. The locking tool of claim 1 wherein the pair of side walls is flat.

12. A method of for using the device in claim 1 in combination with a twist lock new) situated between containers, the method comprising:

the twist lock including an extending lever;

placing the curve arc upon the extending lever;

sliding the shaft forward to surround the extending lever;

once the shaft surrounds the extending lever, a user can pull downward the extending arm allowing the twist lock to rotate.

13. The method of claim 12 further comprising, placing the channel between the pair of extending sidewalls of the second coupler member upon the extending lever allowing the user to pull downward the extending arm wherein the twist lock can rotate.

14. The method of claim 12 further comprising placing the opened shaft of the first coupler member upon a rod of the twist lock allowing the user to rotate the twist lock.

* * * * *